US008579050B2

(12) United States Patent
Pessier et al.

(10) Patent No.: US 8,579,050 B2
(45) Date of Patent: Nov. 12, 2013

(54) REAMER WITH BALANCED CUTTING STRUCTURE FOR USE IN A WELLBORE

(75) Inventors: Rudolf Carl Pessier, Galveston, TX (US); Scott Allan Young, Montgomery, TX (US); Robert J. Buske, The Woodlands, TX (US); Mark Phillip Blackman, Conroe, TX (US); Gregory L. Ricks, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 889 days.

(21) Appl. No.: 12/341,398

(22) Filed: Dec. 22, 2008

(65) Prior Publication Data

US 2009/0218140 A1 Sep. 3, 2009

Related U.S. Application Data

(60) Provisional application No. 61/016,237, filed on Dec. 21, 2007.

(51) Int. Cl.
*E21B 10/26* (2006.01)

(52) U.S. Cl.
USPC ..... 175/344; 175/385; 175/406

(58) Field of Classification Search
USPC ..... 175/57, 344, 347, 385, 386, 406
See application file for complete search history.

(56) References Cited

U.S. PATENT DOCUMENTS

| | | | | |
|---|---|---|---|---|
| 3,805,901 | A * | 4/1974 | Coski | 175/53 |
| 3,858,667 | A * | 1/1975 | Goodfellow | 175/53 |
| 4,071,098 | A | 1/1978 | Dively et al. | |
| 4,248,314 | A * | 2/1981 | Cunningham et al. | 175/344 |
| 5,052,503 | A | 10/1991 | Lof | |
| 5,429,201 | A | 7/1995 | Saxman | |
| 5,456,328 | A | 10/1995 | Saxman | |
| 5,560,440 | A | 10/1996 | Tibbitts | |
| 6,386,298 | B1 | 5/2002 | Smith et al. | |
| 6,446,739 | B1 | 9/2002 | Richman | |
| 6,568,492 | B2 | 5/2003 | Thigpen et al. | |
| 6,609,580 | B2 | 8/2003 | Beaton | |
| 6,729,418 | B2 | 5/2004 | Slaughter et al. | |
| 6,827,161 | B2 | 12/2004 | Singh et al. | |
| 6,902,014 | B1 | 6/2005 | Estes | |
| 6,959,774 | B2 | 11/2005 | Nackerud | |
| 7,066,288 | B2 | 6/2006 | Van Klompenburg et al. | |
| 7,137,460 | B2 | 11/2006 | Slaughter, Jr. et al. | |
| 7,152,702 | B1 | 12/2006 | Bhome et al. | |
| 2002/0020565 | A1 | 2/2002 | Hart et al. | |
| 2004/0074672 | A1 | 4/2004 | Rives | |
| 2005/0252693 | A1 | 11/2005 | Brannstrom | |
| 2006/0096788 | A1 | 5/2006 | Virtanen | |
| 2007/0175664 | A1 | 8/2007 | Holmgren | |
| 2009/0159338 | A1 * | 6/2009 | Buske | 175/57 |
| 2009/0166093 | A1 * | 7/2009 | Pessier et al. | 175/335 |

OTHER PUBLICATIONS

International Search Report Dated Jul. 24, 2009, for Related Application PCT/US2008/087982.

* cited by examiner

*Primary Examiner* — Kenneth L Thompson
*Assistant Examiner* — Elizabeth Gitlin
(74) *Attorney, Agent, or Firm* — Bracewell & Giuliani LLP

(57) ABSTRACT

A reamer bit for use in earth boring operations comprising a body, four cutter mounts, rolling cutters on each mount, and cutting elements disposed on each cutter arranged so adjacent cutting swaths formed by the bit are created by cutting elements on cones of oppositely disposed cutter mounts. The swaths are generally curvilinear, wherein the outermost swaths are formed by cutting element rows on the outer portion of the cutters. The reamer bit can further comprise a pilot bit.

12 Claims, 4 Drawing Sheets

REAMER WITH BALANCED CUTTING STRUCTURE FOR USE IN A WELLBORE

RELATED APPLICATIONS

This application claims priority to and the benefit of co-pending U.S. Provisional Application Ser. No. 61/016,237, filed Dec. 21, 2007, the full disclosure of which is hereby incorporated by reference herein.

BACKGROUND

1. Field of Invention

This disclosure relates to earth boring reamer bits, and particularly to reamer bits having a balanced cutting structure.

2. Description of Prior Art

Drill bits used in drilling of subterranean well bores typically comprise fixed cutter bits and roller cone bits. Roller cone bits typically comprise a body having legs extending downward and a head bearing extending from the leg towards the axis of the bit body. Frustoconically shaped roller cones are rotatably mounted on each of these journals and are included with cutting teeth on the outer surface of these cones. As the bit rotates, the cones rotate to cause the cutting elements to disintegrate the earth formation.

In some situations a pilot reamer drilling system is employed where two or more bits are combined on a single drill string. Here the lowermost bit, commonly referred to as a pilot bit, creates a pilot hole and an upper earth boring bit enlarges the pilot hole diameter. The bit enlarging the hole diameter is referred to as a reamer. Typically the pilot bit comprises a conventional bit, i.e. either a roller cone bit or a fixed cutter bit. The reamer bit usually employs rolling cutters as cutting members that are attached to the reamer body. Pilot reamer drilling systems are used to drill large diameter boreholes that require enhanced stabilization.

SUMMARY OF INVENTION

The disclosure herein describes a reamer bit for downhole earth boring operations comprising, a reamer body having an axis, four rolling cutters mounted on the body, and rows of cutting elements on the cutters. Each row of cutting elements makes a generally circular path during earth boring operations. A first circular path is made by a first row of cutting elements, a second circular path is made by a second row of cutting elements, and the first circular path is directly adjacent the second circular path. The first row of cutting elements is disposed on a cutter oppositely positioned on the reamer body from the cone having the second row of cutting elements. Optionally, the radial distance from a cutter mount to a first adjacent cutter mount is different than the radial distance from the cutter mount to a second adjacent cutter mount. Pockets may be provided on the body outer diameter formed to receive the cutter mounts therein. The reamer bit can be attached to a drill shaft which is threaded at its upper end has a pilot for connection into a drill string and bit affixed to the drill shaft lower end. The pilot bit may be a roller cone bit or a fixed cutter bit.

The present disclosure also includes a method of forming a reamer bit apparatus used in creating a wellbore. The method comprises forming a bit body, forming four cutter mounts for attachment to the bit body outer periphery, forming four rolling cutters one through four for attachment to the cutter mounts and to engage a cutting surface within the wellbore. The method includes adding rows of cutting elements to the roller cones and configuring the rows such that the rows form a pattern of concentric curvilinear swaths on a cutting surface, wherein a pair of directly adjacent curvilinear swaths are formed by rows disposed on cones disposed on opposite sides of the reamer body. Adding the cutter mounts to the periphery of the body is further included with the method. The method may further comprise numbering each cutter one through four in the order in which they engage the borehole bottom during rotation, wherein each cutter has a first and a second inner row of cutting elements, arranging the rows in the following order for respectively forming the outermost to innermost concentric curvilinear swaths, the order being (1) the first inner row of the fourth cone; (2) the first inner row of the second cone; (3) the first inner row of the third cone; (4) the first inner row of the first cone; (5) the second inner row of the fourth cone; (6) the second inner row of the second cone; (7) the second inner row of the third cone; and (8) the second inner row of the first cone. In one embodiment, the method comprises numbering the four cutter mounts, disposing mounts one through three in clockwise sequence around the bit body, wherein the angle between the centerlines of cutter mount one and two and two and three is approximately 90°, and asymmetrically disposing cutter mount four on the bit body between bit legs one and three.

BRIEF DESCRIPTION OF DRAWINGS

Some of the features and benefits of the present invention having been stated, others will become apparent as the description proceeds when taken in conjunction with the accompanying drawings, in which.

Figure 1:
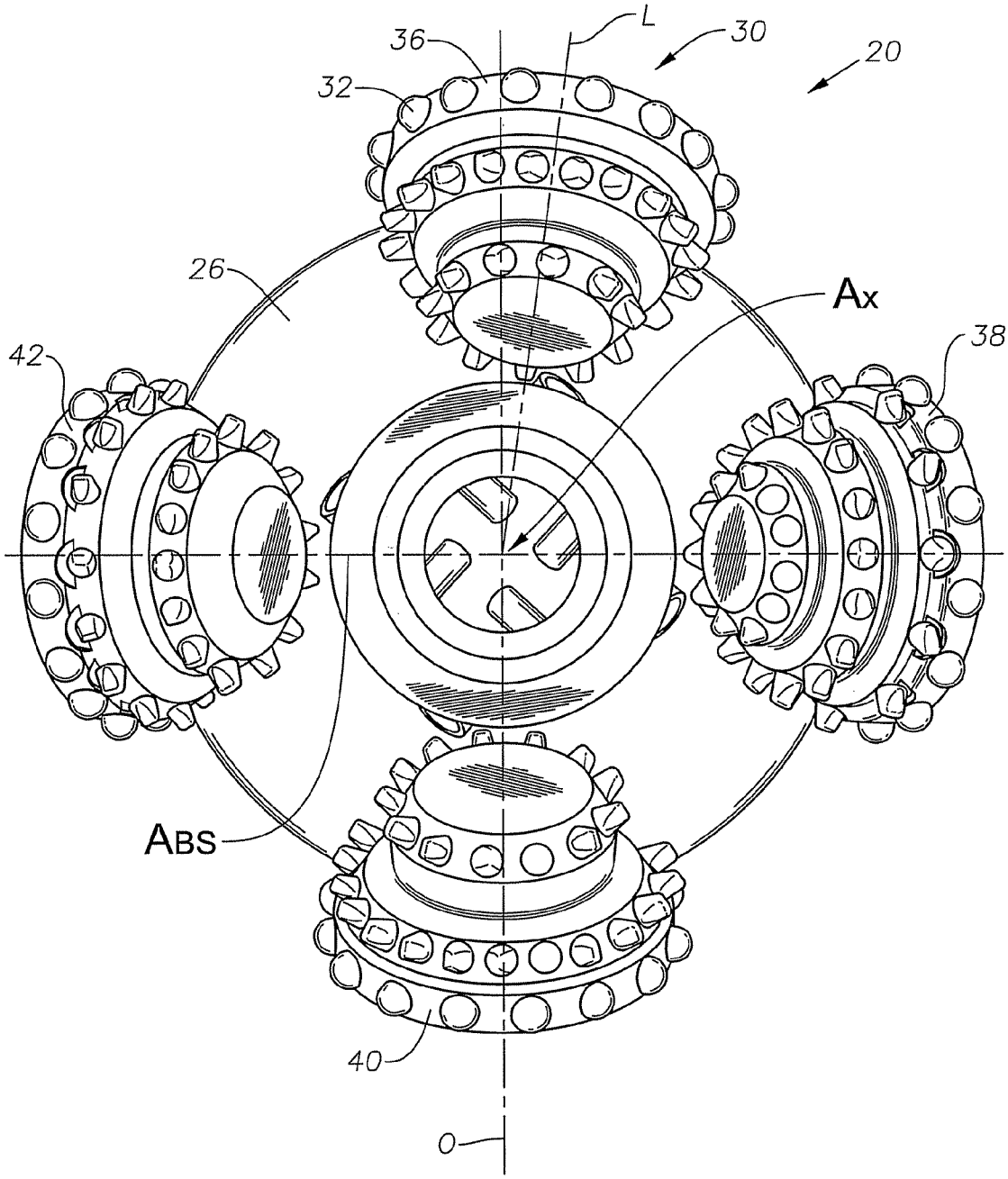
FIG. 1 is an upward looking view of a reamer bit in accordance with the present disclosure having rolling cutters spaced around a bit body, with an unequal spacing between some of the cutters.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

FIG. 1 provides an upward looking view of one embodiment of a reamer assembly 20. The reamer assembly 20 comprises a generally cylindrically shaped reamer body 26, having cutter mounts 28 (shown in FIG. 3) formed on its outer radial periphery. Each cutter mount 28 includes a shaft (not shown) generally angled towards the axis A of the body 26. Rolling cutters 30 are rotatably disposed on each shaft. In the embodiment of FIG. 1, the reamer assembly 20 comprises four rolling cutters 30. For convenience, the cutters are referred to herein as a first cutter 36, a second cutter 38, a third cutter 40, and a fourth cutter 42. Each cutter includes rows of teeth 32 circumferentially disposed on the surface of each cutter 30. The first and third cutters (36, 40) are oppositely disposed from one another and the second and fourth cutters (38, 42) are oppositely disposed from one another. For purposes of discussion herein, the phrase "oppositely disposed" refers to cutters that are not adjacent to one another.

For the purposes of reference and convenience, FIG. 1 includes a coordinate axis superimposed over the reamer assembly 20. The coordinate axis comprises an ordinate line O intersecting the reamer axis $A_X$ and an abscissa $A_{BS}$ intersecting the ordinate O at the reamer axis $A_X$. In the embodiment of the reamer assembly 20 of FIG. 1, the axes of the second, third and fourth roller cones (38, 40, 42) are substantially aligned with either the ordinate O or the abscissa $A_{BS}$. However, the first roller cone 32 is positioned such that its axis, shown aligned with line L, is not aligned with either the abscissa $A_{BS}$ or ordinate O. Thus the roller cones are asymmetrically positioned around the body 26. This asymmetric arrangement reduces harmful dynamics that may occur with the reamer assembly 20. Although a single rolling cutter is shown in an asymmetric orientation, additional cones may be asymmetrically disposed.

Figure 2:
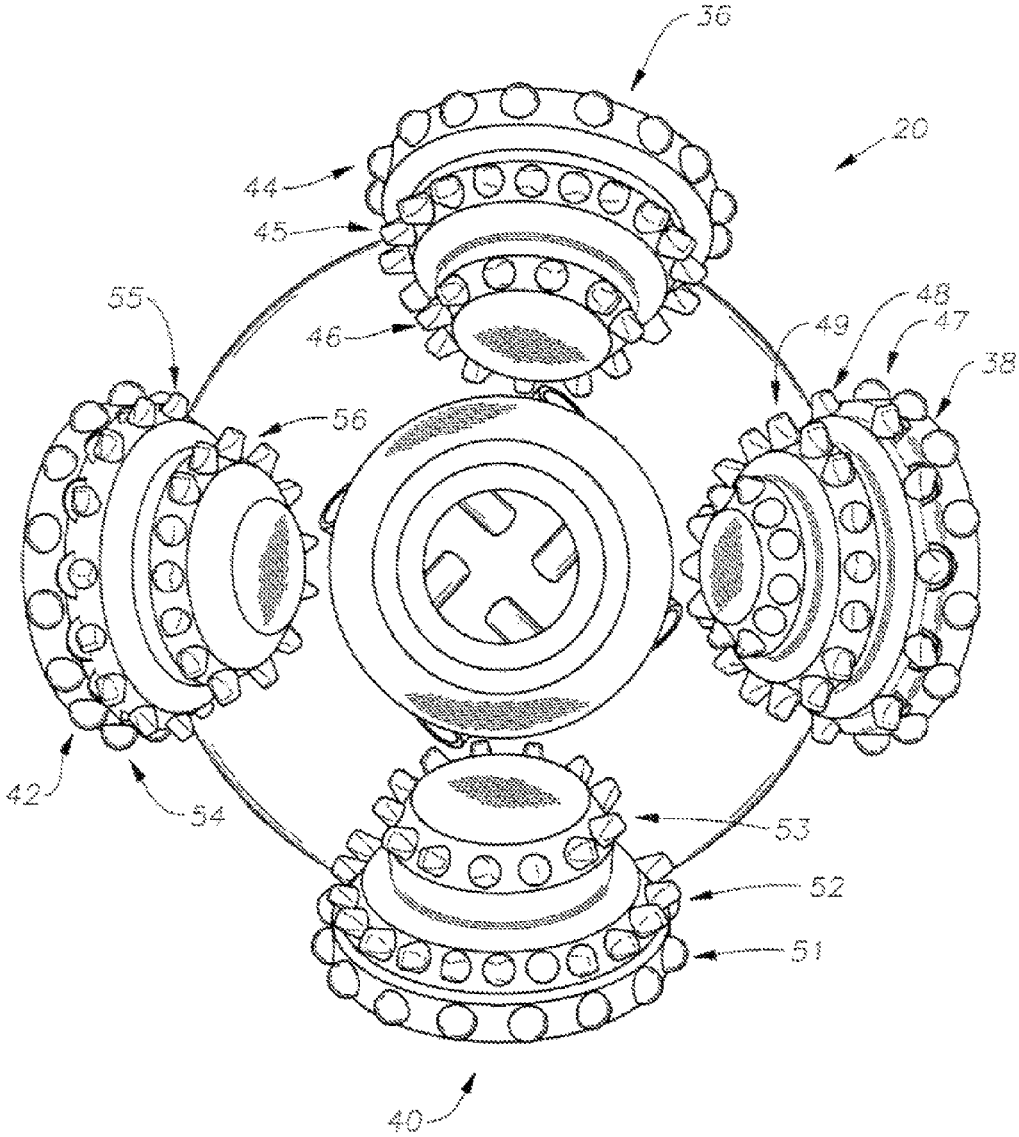
FIG. 2 is an upward looking view of a reamer bit, having rolling cutters with associated cutting elements arranged in rows, where the elements are arranged to balance the bit.

FIG. 2 provides an upward looking view of an embodiment of the reamer assembly 20. Here the rows of cutting elements circumferentially arranged around the cutters are identified and assigned reference identifiers. While drilling a well bore, the cutting elements of each row follow a particular path on the associated cutting surface while the reamer is being rotated. Thus each row creates a swath or groove on the cutting surface coinciding with its respective path. Typically, each individual row on the specific cutter will have a resulting path or swath of a distinct radius different from the radius of swaths cut by any other row of cutting elements on the reamer. These paths are generally curvilinear and concentric with one another.

The cutting element rows of the reamer assembly 20 of the present disclosure are arranged such that rows of elements on oppositely placed cutters follow directly adjacent paths. For the purposes of disclosure herein, directly adjacent path means the paths reside next to one another with no other path therebetween. Having rows of cutting elements on oppositely disposed cutters that follow directly adjacent paths balances the reamer assembly 20 during drilling.

Figure 3:
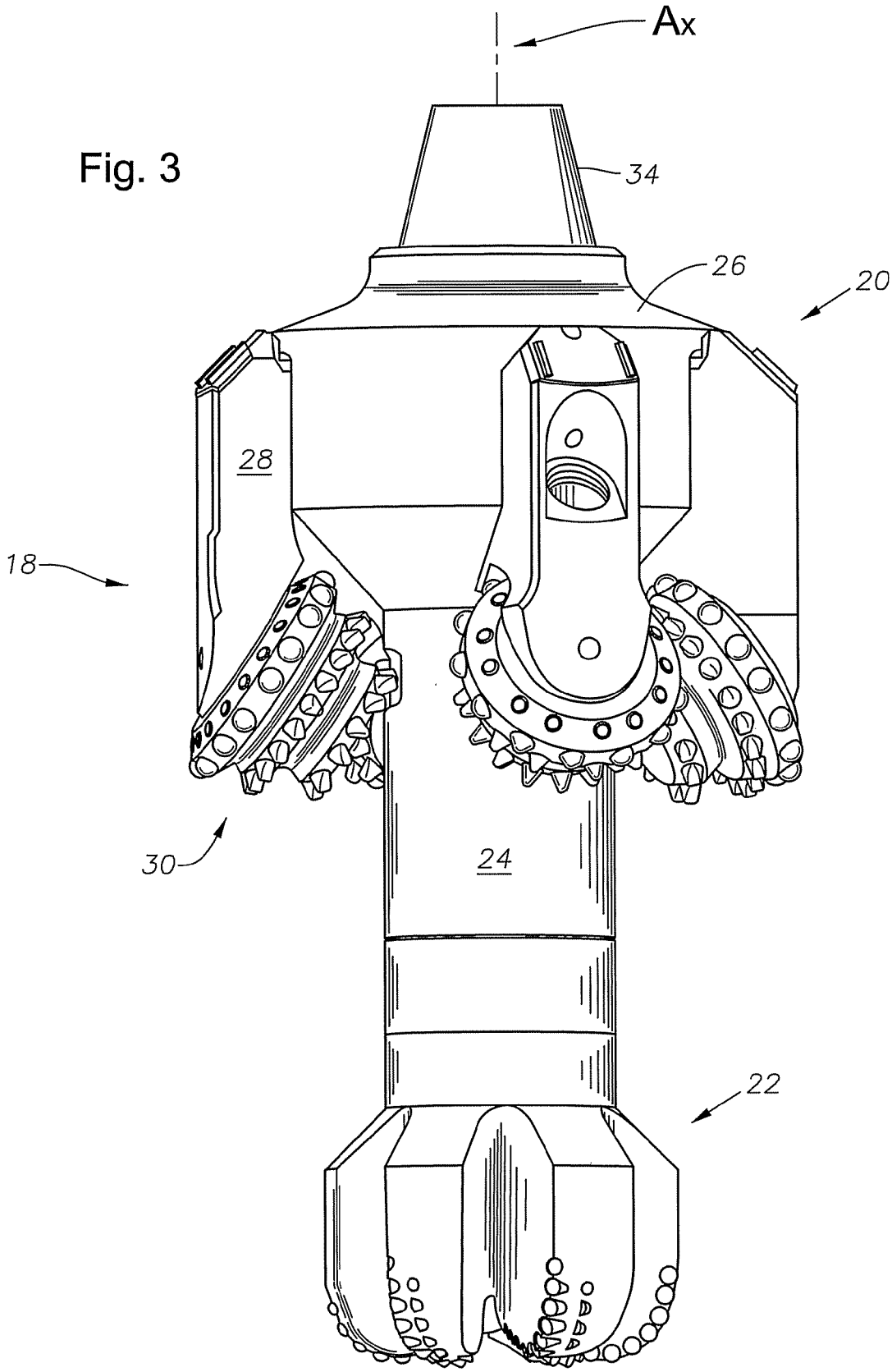
FIG. 3 is a side view of a pilot reamer bit apparatus having a reamer bit and a pilot bit.

FIG. 3 is a side view of a reamer assembly 20 having a shaft 24 formed on the lower portion of body 26 and a pilot bit 22 attached to the terminal end of the shaft 24. Combining a reamer assembly 20 with a pilot bit 22 by means of shaft 24 forms a pilot reamer assembly 18. The pilot bit 22 is shown as a fixed cutter bit, however this bit may also comprise a roller cone bit. A connector 34 is provided on the upper end of the reamer body 26 having threads for connection to a drill string. The connector 24 is substantially coaxially disposed with the reamer body axis $A_X$. The cutter mounts 28 are attached at the periphery of the reamer body 26.

Figure 4:
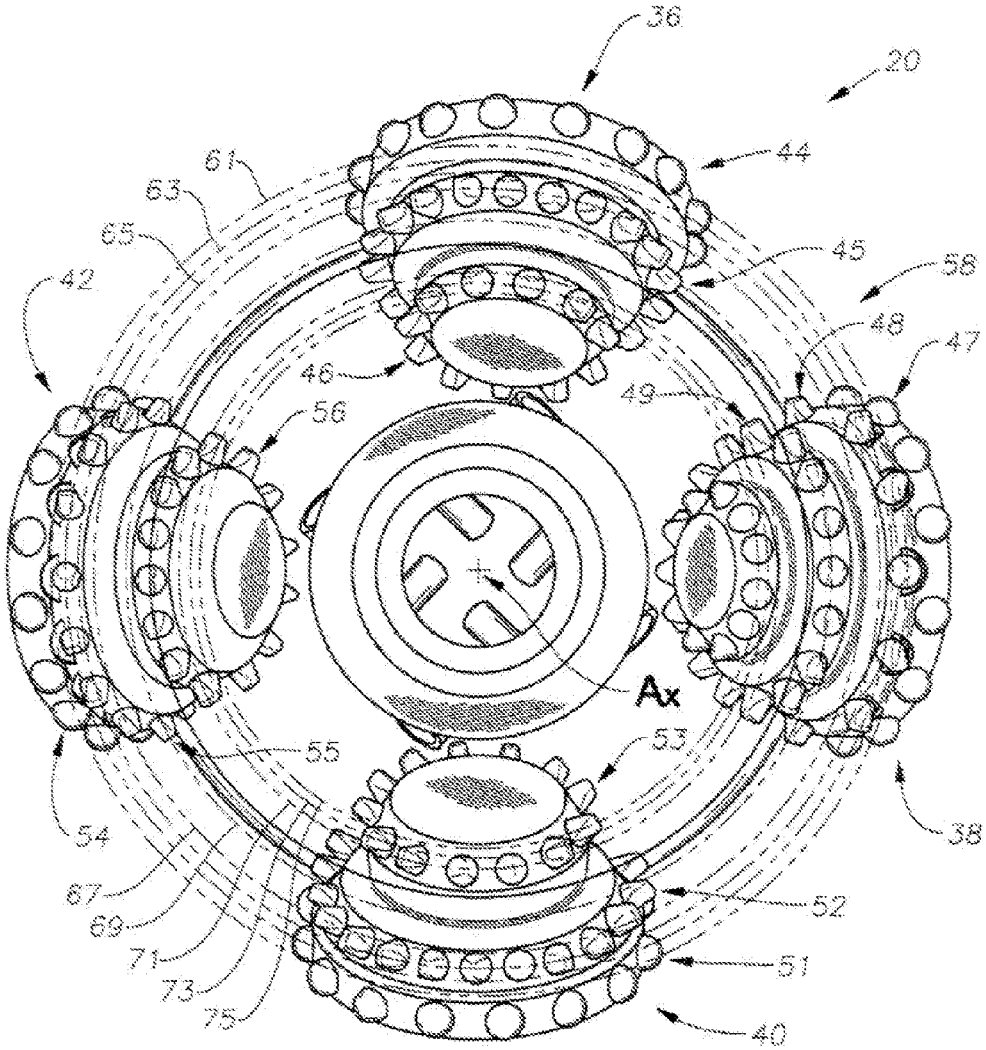
FIG. 4 illustrates paths followed by, or grooves formed by, rows of cutting elements on reamer bit cones.

FIG. 4 provides an upward looking view to an embodiment of a reamer assembly 20 in contact with a cutting surface 58. The cutting surface 58 includes a series of concentrically arranged circles representing paths formed by the rows of cutting elements in the cutting surface 58.

Example 1

In one example of use of the apparatus and method herein described, a sequence of rows is correlated with corresponding or associated paths. For the purposes of reference, the paths of FIG. 4 are referred to as the first outermost path 61, the second outermost path 63, the third outermost path 65, the fourth outermost path 67, the fifth outermost path 69, the sixth outermost path 71, the seventh outermost path 73, and the eighth outermost outmost path 75. As shown in FIGS. 2 and 4, each cutter (36, 38, 40, 42) is identified by a reference numeral. In the example illustrated in FIG. 4, path 63 is formed by the first inner row 55 of the fourth cutter 42. Path 61 is formed by the first inner row 48 on the second cutter 38. Path 67 is formed by the first inner row 52 on the third cutter 40. Path 65 is formed by the first inner row 45 on the first cutter 36. Path 71 is formed by the second inner row 56 on the fourth cutter 42. Path 69 is formed by the second inner row 49 on the second cutter 38. Path 75 is formed by the second inner row 53 on the third cutter 40. Path 73 is formed by the second inner row 46 on the first cutter 36. As can be seen from this example, adjacent paths are associated with rows from oppositely disposed cones.

It should be pointed out that the cutting elements on the rolling cutters include cutting teeth that are milled onto the surface of the rolling cutters, as well as compacts or inserts that are retained by interference fit in corresponding orifices on the rolling cutter. The cutting elements therefore can be comprised of hard faced steel, tungsten carbide or other super hard materials. Moreover, the reamer bit is not limited to embodiments having the number of cones illustrated, reamer bits embodying the attributes discussed herein may include fewer than four cones (two or three) and more than four cones (five or more).

The invention claimed is:

1. A reamer bit for downhole earth boring operations comprising:

a reamer body having a longitudinal axis;

first through fourth cutter mounts attached to the body at about the same distance from the axis and spaced sequentially around the axis;

cutters rotatably secured to each mount, each cutter having a gage surface for engaging a wall of a borehole and a nose on an inner side of each of the cutters;

a heel row of cutting elements adjacent the gage surface on each of the cutters for engaging an outer portion of the bottom of the borehole, the heel rows on the cutters being the same distance from the axis;

inner rows of cutting elements on the cutters inward from the heel row, wherein the inner row include:

a first inner row next to the heel row on the first cutter and farther from the axis than any other inner rows on any of the cutters;

a first inner row on the third cutter that is the second farthest from the axis of all of the inner rows of the cutters;

a first inner row on the second cutter that is the third farthest from the axis of all of the inner rows of the cutters; and a first inner row on the fourth cutter that is the fourth farthest from the axis of all of the inner rows of the cutters.

2. The reamer bit according to claim 1, wherein one of the mounts is asymmetrically positioned such that the arcuate distance from said one of the mounts to an adjacent mount on one side is different than the arcuate distance from said one of the mounts to an adjacent mount on the other side.

3. The reamer bit according to claim 1, further comprising pockets provided on the body outer diameter formed to receive the mounts therein.

4. The reamer bit according to claim 1, further comprising:

a drill shaft extending from the body lower end;

a pilot hit affixed to the drill shaft terminal end; and wherein the noses of the cutters are closer to the axis than a periphery of the pilot bit.

5. The reamer bit according to claim 1, further comprising:

a second inner row on the first cutter closer to the axis than any of the first inner rows on any of the cutters;

a second inner row on the third cutter that is the closer to the axis than the second inner row of the first cutter;

a second inner row on the second cutter that is the closer to the axis that the second inner row on the third cutter; and a second inner row on the fourth cutter that is the closer to the axis than the second inner row of the second cutter.

6. A reamer drill bit for use in forming a wellbore, the bit comprising:

a bit body having a longitudinal axis;

a drill shaft extending from a lower end of the body and a pilot bit affixed to the drill shaft terminal end;

first, second, third, and fourth cutter mounts disposed in respective sequential order on the periphery of the bit body and at about the same distance from the axis of the bit body, wherein the first and third cutter mounts are oppositely disposed on the hit body and the second and fourth cutter mounts are oppositely disposed on the bit body;

first, second, third, and fourth cutters rotatably mounted on the first, second, third, and fourth cutter mounts, respectively, each of the cutters having a cage surface on an outer side and a nose on an inner side, the noses being located closer to the axis than a periphery of the pilot bit;

a heel row of cutting elements mounted on each of the cutters for engaging an outer periphery of a borehole, the heel rows being the same distance from the axis;

inner rows of cutting elements concentrically arranged on each of the cutters inward from the heel rows; wherein the inner rows comprise:

an outermost inner row on the first cutter farther from the axis than any other of the inner rows;

an outermost inner row on the third cutter farther from the axis than any other of the inner rows, except not as far from the axis than the outermost inner row on the first cutter;

an outermost inner row on the second cutter further from the axis than any other of the inner rows, except not as far from the axis than the outermost inner rows on the first and third cutters; and an outermost inner row on the fourth cutter farther from the axis than any other of the inner rows, expect not as far from the axis than the outermost inner rows on the first, second and third cutters.

7. The reamer bit of claim 6, wherein the distances from the inner rows to the axis are selected so that:

curvilinear paths formed on the borehole bottom by the cutting elements in the outermost inner rows on the first and third cutters do not overlap with one another; and curvilinear paths formed on the borehole bottom by the cutting elements in the outermost inner rows on the second and fourth cutters do not overlap with one another.

8. The reamer bit of claim 6, further comprising:

a second outermost inner row on the first cutter closer to the axis than any of the outermost inner rows on any of the cutters;

a second outermost inner row on the third cutter that is the closer to the axis than the second outermost inner row of the first cutter;

a second outermost inner row on the second cutter that is the closer to the axis that the second outermost inner row on the third cutter; and a second outermost inner row on the fourth cutter that is the closer to the axis than the second outermost inner row of the second cutter.

9. The reamer hit of claim 6, wherein one of the mounts has a centerline 90 degrees from centerlines of the mounts on opposite sides, and another one of the mounts has a centerline greater than 90 degrees to the mount on one side and less than 90 degrees to the mount on the other side.

10. A method of forming a reamer bit apparatus used in creating a wellbore comprising:

forming a bit body with a longitudinal axis;

forming four cutter mounts for attachment to the bit body periphery and attaching each cutter mount to the bit body at about the same distance from the axis of the bit body;

forming first through fourth rolling cutters for attachment to the mounts in sequential order around the axis to engage a cutting surface within a wellbore, each cutter having a gage surface to define a diameter of the wellbore, each cutter having a heel row of cutting elements adjacent the gage surface, the heel rows being located the same distance from the axis;

installing inner rows of cutting elements to the rolling cutters inward from the heel rows and positioning the inner rows as follows:

a first inner row next to the heel row on the first cutter and farther from the axis than any other inner rows on any of the cutters;

a first inner row on the third cutter that is the second farthest from the axis of all of the inner rows of the cutters:

a first inner row on the second cutter that is the third farthest from the axis of all of the inner rows of the cutters; and a first inner row on the fourth cutter that is the fourth farthest from the axis of all of the inner rows of the cutters.

11. The method of forming a reamer bit apparatus of claim 10, further comprising adding a pilot bit.

12. The method of forming a reamer bit apparatus of claim 10, further comprising, disposing the mounts wherein circumferential angle between a centerline of one of the mounts and centerlines of the mounts on each side is approximately 90°, and a centerline of an asymmetrical mount and the centerlines of the mounts on each side of the asymmetrical mount is other than 90 degrees.

* * * * *